United States Patent [19]

Yanagida et al.

[11] 4,059,494

[45] Nov. 22, 1977

[54] PROCESS FOR CONTINUOUS ELECTROLYTIC COLORING OF ALUMINUM OR ALUMINUM BASE ALLOY STRIP AND WIRE

[75] Inventors: Kiyomi Yanagida; Tadashi Hirokane; Tadashi Tsukiyasu; Tomoari Sato, all of Nagoya, Japan

[73] Assignee: Sumitomo Aluminum Smelting Co., Ltd., Osaka, Japan

[21] Appl. No.: 788,386

[22] Filed: Apr. 18, 1977

Related U.S. Application Data

[63] Continuation of Ser. No. 633,198, Nov. 19, 1975, abandoned.

[30] Foreign Application Priority Data

Nov. 19, 1974 Japan ..... 49-133433
Nov. 19, 1974 Japan ..... 49-133434

[51] Int. Cl.[2] ..... C25D 9/12
[52] U.S. Cl. ..... 204/28; 204/206
[58] Field of Search ..... 204/28, 206, 207, 208, 204/209, 210, 211

[56] References Cited

U.S. PATENT DOCUMENTS

| | | | |
|---|---|---|---|
| 3,650,935 | 3/1972 | Anderson | 204/206 |
| 3,692,640 | 9/1972 | Hamabe et al. | 204/28 |
| 3,871,982 | 3/1975 | Idstein | 204/207 |

*Primary Examiner*—G. L. Kaplan
*Attorney, Agent, or Firm*—Sughrue, Rothwell, Mion, Zinn and Macpeak

[57] ABSTRACT

An improved process for electrolytically coloring an anodically oxidized aluminum or aluminum base alloy strip or wire which comprises, while continuously travelling the strip or wire through an electrolytic coloring means, subjecting the anodically oxidized strip or wire as a cathode to direct current electrolysis using an electrolytic coloring means comprising at least one hollow body having an opening for continuously supplying a coloring bath onto the surface of the oxidized strip or wire and an electrode acting as an anode therein, and continuously supplying the coloring bath through the opening of the hollow body onto the surface of the oxidized strip or wire.

5 Claims, 2 Drawing Figures

PROCESS FOR CONTINUOUS ELECTROLYTIC COLORING OF ALUMINUM OR ALUMINUM BASE ALLOY STRIP AND WIRE

This is a continuation of application Ser. No. 633,198, filed Nov. 19, 1975, now abandoned.

BACKGROUND OF THE INVENTION

1. Field of the Invention

This invention relates to a process for the continuous electrolytic coloring of an article of aluminum or an aluminum base alloy (hereinafter referred to aluminum) in a windable shape, such as an aluminum strip or wire.

2. Description of the Prior Art

Various processes for the electrolytic coloring of aluminum comprising subjecting aluminum which has previously been anodically oxidized to electrolysis in an electrolytic coloring bath comprising an aqueous solution of at least one nickel salt, cobalt salt, tin salt, iron salt, copper salt or selenious acid, the aluminum serving as an electrode, are well known in the art. These electrolytic coloring processes are known to be economically advantageous as they enable one to produce electrolytically colored aluminum articles with excellent reproducibility which are uniform in color. In addition, because of their excellent weatherability or fade resistance, the resulting electrolytically colored aluminum generally can be used as structural materials such as extrusions, plates and the like.

Known electrolytic coloring processes can be classified as alternating current electrolysis processes as disclosed in U.S. Pat. No. 3,382,160 or direct current electrolysis processes as disclosed in U.S. Pat. No. 3,761,362, depending upon the kind of electric current which is passed through the electrolytic coloring bath.

The process disclosed in U.S. Pat. No. 3,761,362 is characterized by the coloration of a previously anodized aluminum by subjecting the aluminum to a direct current electrolysis, with the aluminum as a cathode, in an electrolytic coloring bath comprising an aqueous solution containing at least one nickel salt, cobalt salt, tin salt, iron salt, copper salt or selenious acid.

In this direct current electrolysis, the composition of the electrolytic coloring bath is suitably selected from the above-described components depending on the desired color. Generally, the color formed on the surface of the aluminum is bronze when a nickel salt is used, reddish-brown when a copper salt is used, bronze to black when a tin salt is used, bronze when a cobalt salt is used, yellow when an iron salt is used, and yellow to reddish-orange when selenious acid is used.

The above direct current electrolytic coloring process can be carried out in a continuous manner which is advantageous in that electrolytically colored aluminum can be obtained economically by continuously anodically oxidizing a windable aluminum article such as strips, wires and the like, and then subjecting the resulting anodically oxidized aluminum article to a direct current electrolytic coloring process, followed by conventional final treatments such as a sealing treatment or various coating treatments. However, when the electrolytic coloring process is effected in a conventional electrolytic cell containing an electrolytic coloring bath by continuously supplying aluminum as a cathode from one end of the electrolytic coloring cell which is provided with an anode on an inside wall or on the bottom of the cell and with agitation means for the coloring bath, e.g., by injecting air or the coloring bath into the cell, it is very difficult to obtain a uniformly colored aluminum in a stable manner. That is, satisfactory coloring is difficult to conduct due to the problems hereinafter described, whereby the resulting color tone tends to be non-uniform, for example, a stripe-pattern comprising a deeply-colored portion and an unattractive lightly-colored portion results, and the electrolytically colored film on the aluminum tends to be partially spalled. These phenomena are frequently observed with an electrolytic coloring process conducted on a large industrial scale, and are liable to occur as the travelling speed of the aluminum passing through the coloring bath increases and the electric current applied to the coloring bath increases.

SUMMARY OF THE INVENTION

An object of this invention is to provide a direct current process for the continuous electrolytic coloring of a windable aluminum strip or wire.

Another object of this invention is to provide a process for producing a uniformly colored aluminum strip or wire in a stable manner by a direct current electrolytic coloring process which eliminates the problems associated with conventional processes such as irregular stripe-pattern coloration and spalling of the electrolytically colored oxide film on the aluminum strip or wire.

As a result of studies on processes for the continuous electrolytic coloring of aluminum, it was found that the above-described disadvantages associated with conventional processes are due to the fact that during electrolytic coloring the electric current is partially concentrated, in particular, at portions of the aluminum which come into contact with the coloring bath, and that hydrogen gas generated on the surface of the aluminum as a cathode is difficult to completely remove.

The present invention provides an improved process for electrolytically coloring an anodically oxidized aluminum strip or wire which comprises, while continuously travelling the strip or wire through an electrolytic coloring means, subjecting the anodically oxidized aluminum strip or wire as a cathode to direct current electrolysis using an electrolytic coloring means comprising at least one hollow body having an opening for continuously supplying a coloring bath onto the surface of the aluminum strip or wire and an electrode acting as an anode in the hollow body, and continuously supplying the coloring bath through the opening of the hollow body onto the surface of the aluminum strip or wire.

DETAILED DESCRIPTION OF THE INVENTION

Figure 1:
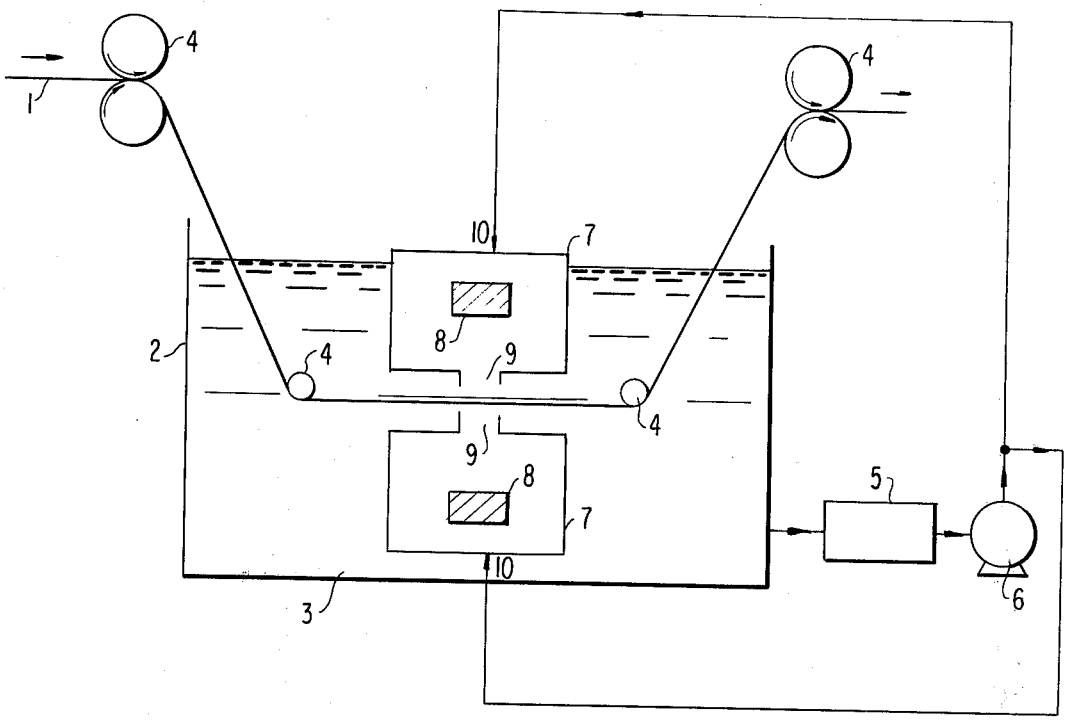
FIGS. 1 and 2 are schematic drawings illustrating embodiments of an electrolytic coloring system in accordance with the present invention.

The anodic oxidation carried out prior to the electrolytic coloring treatment of this invention is usually carried out in an anodic oxidation bath comprising an aqueous solution of about 10 to 55% sulfuric acid with a current density of from 3 to 50 A/dm$^2$, but, if desired, the anodic oxidation bath may further contain a small amount of a salt such as magnesium chloride, sodium sulfate, magnesium sulfate, sodium chloride, etc.; a carboxylic acid; an organic sulfonic acid; and/or an amine. The electric current used for the anodic oxidation can be a direct current or direct and alternating superposed currents.

The direct current electrolysis for coloring of an aluminum strip or wire according to the present invention can be carried out using conventional electrolytic coloring baths.

The main component of the electrolytic coloring bath used herein is one or more water-soluble metal salts such as water-soluble nickel salts (such as nickel sulfate, nickel chloride, nickel acetate and the like), copper salts (such as cupric sulfate and the like), tin salts (such as stannous chloride, stannous sulfate and the like), cobalt salts (such as cobalt sulfate, cobalt acetate and the like), iron salts (such as ferrous sulfate and the like), like metal salts, and selenious acid. Further, if desired, the electrolytic bath may contain a suitable amount of boric acid or sulfuric acid to control the pH and the electric conductivity of the bath. For example, when the main component is nickel sulfate, boric acid is often used in combination with nickel sulfate, with both components being capable of use over a relatively wide range of concentrations, for example, about 15 to 100 g/liter of nickel sulfate and about 10 to 50 g/liter of boric acid producing a superior colored oxide film.

The term "direct current" as used herein means an electric current which always flows in a fixed direction, as is well known. Therefore, the direct current is not limited by the wave form thereof and it includes all electric currents which have a wave form periodically changing in current strength, so long as the direction of the current flow is not changed.

The current density used in the electrolytic coloring process of this invention can range from about 0.05 to 3.0 $A/dm^2$, but a range of 0.1 to 2.0 $A/dm^2$ is preferred from an operational point of view. Further, bath temperatures in the vicinity of room temperature are sufficient, but a temperature of from about 10° to 40° C can also be used for coloring.

The period during which time the coloring phenomenon occurs, i.e., the actual coloring time, varies depending upon the distance between the surface of the aluminum strip or wire and the opening of the hollow body employed in the present invention, but is generally adjusted to be less than about 30 seconds, preferably from 2 to 15 seconds. The coloring time used herein means the actual time when the aluminum strip or wire contacts the coloring bath and the coloring phenomenon actually occurs. Therefore, the coloring time is not always identical with the contact time of the aluminum strip or wire with the coloring bath. That is, the region where the coloring phenomenon occurs is not determined with reference to the length of aluminum strip or wire contacting with the coloring bath, rather, it is determined by the region of current distribution having the specified current density through the opening of hollow body from the anode onto the surface(s) of the aluminum strip or wire treated. The time when the aluminum strip or wire passes through this region corresponds to the coloring time as defined above.

The narrower the distance between the lower portion of the opening provided in the hollow body and the surface(s) of the aluminum strip or wire to be treated, the easier the coloring operation is. The minimum distance can be easily determined by a simple pre-experiment from the viewpoint of the size of the apparatus used, the bending degree of the aluminum strip or wire, the uniformity of coloring, etc. The maximum distance is not particularly limited, but is preferably controlled to be less than about 100 mm from the viewpoint of the electric power consumed.

The amount of the coloring bath which is supplied to the surface(s) of aluminum strip or wire via the opening of the hollow body is not particularly limited, and can generally be varied depending upon the degree of desorption of hydrogen gas generated on the surface(s) of the aluminum strip or wire during the electrolysis step.

The process of this invention will be further illustrated in greater detail by reference to the accompanying drawings.

FIG. 1 is a schematic sectional side view of an embodiment of the apparatus used in the process of this invention. In FIG. 1, 1 is an aluminum strip or wire which has previously been anodically oxidized by a conventional process. This anodically oxidized aluminum strip or wire 1 is used as a cathode by applying electric current using the liquid electric supply method or the roll electric supply method. 2 is an electrolytic coloring cell containing a coloring bath 3 for obtaining the desired color as earlier described. 4 represents a pair of rollers for travelling the aluminum strip or wire to be electrolytically colored, which rollers can be provided at any convenient positions. 5 is a heat exchanger for controlling the temperature of the coloring bath. 6 is a pump for supplying the coloring bath to an electrolytic coloring means comprising a hollow body 7 while circulating the coloring bath. The hollow body 7 which characterizes this invention is provided with an anode 8 inside the cavity of the hollow body, which anode 8 is electrically insulated from the hollow body, and has an opening 9 for continuously supplying the coloring bath onto the surface of the travelling aluminum strip or wire and has at least one inlet 10 for introducing the circulating coloring bath into the hollow body 7.

In FIG. 1, two hollow bodies are positioned facing the upper surface and the lower surface of the aluminum strip or wire 1, respectively, but this pair of hollow bodies can be modified so as to integrate the two hollow bodies into a single hollow body or, alternatively, two or more hollow bodies can be provided at each of the upper and lower surfaces of the aluminum strip or wire to be electrolytically colored.

In carrying out the process of this invention, the anodically oxidized aluminum strip or wire 1 is first thoroughly rinsed with water and then introduced by means of driving rollers, guide rollers or the like into the electrolytic coloring cell 2 where the aluminum strip or wire is brought into contact with the coloring bath 3. The aluminum strip or wire 1 further travels in the coloring bath and approaches the hollow bodies 7 where the aluminum strip or wire is to be electrolytically colored. The coloring rate of the aluminum strip or wire increases as the aluminum strip or wire approaches the hollow bodies and decreases as the strip or wire travels away from the hollow bodies. A strip or wire which is completely colored finally emerges from the coloring bath.

Of course, during the above coloring procedure, direct current is passed through the coloring bath between the aluminum strip or wire as a cathode and the anode provided in the hollow body or bodies 7.

As described above, the characteristic feature of the present invention resides in that coloring occurs at areas where the aluminum strip or wire to be electrolytically colored approaches close to the hollow bodies 7.

The hollow body 7 used in the present invention as the electrolytic coloring means includes any type of hollow member which can be provided with an anode therein electrically insulated from other portions of the hollow body, and which has at least one inlet for introducing a coloring bath and an opening for supplying a coloring bath by flowing the same toward a travelling aluminum strip or wire disposed adjacent the bath supply opening. The hollow body can be of any shape, for example, cylindrical or box-like. The opening in the hollow body is preferably a slit shape, the longitudinal direction of the slit being perpendicular to the travelling direction of the aluminum strip or wire, but it may be of any shape so long as the opening is capable of flowing the coloring bath uniformly toward the travelling aluminum strip or wire.

The anode is also preferably arranged perpendicular to the travelling direction of the aluminum strip or wire, and is advantageously made from a material which is convenient for the maintenance of the coloring bath used, for example, a nickel plate when the coloring bath contains nickel ions. The amount of the coloring bath flowing or ejected through the opening can be controlled by liquid flow control means such as a valve, after pump 6.

The flow rate of the coloring bath and the slit width of the opening are not critical, and vary depending upon various parameters used in the process, but in large scale industrial apparatus it is preferred to use higher flow rates and larger slit widths as the travelling rate of the aluminum strip or wire increases.

Figure 2:
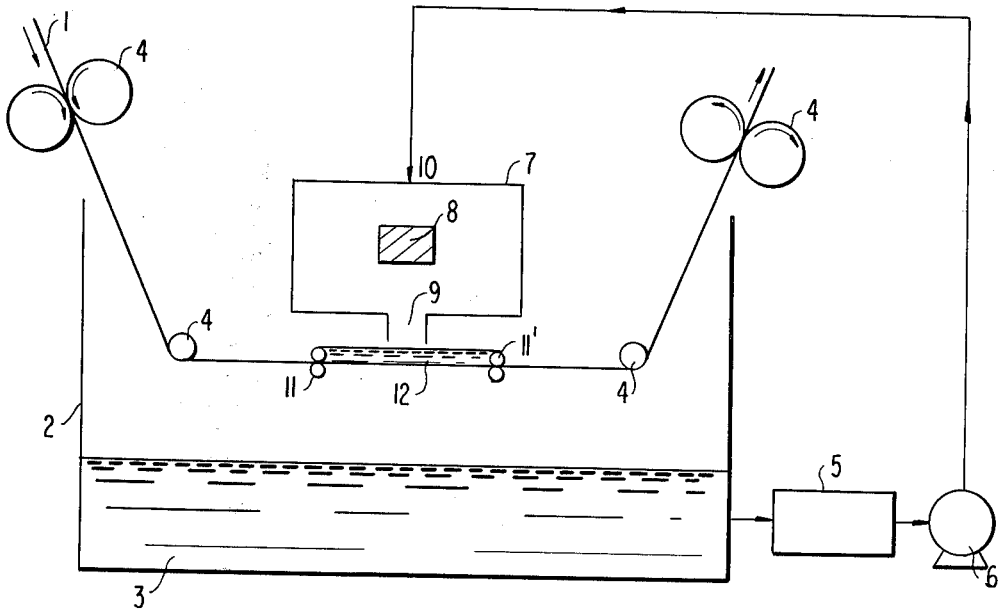

In another embodiment of the process of this invention, it is possible to electrolytically color only one surface of an aluminum strip by, for example, using an apparatus as illustrated in FIG. 2.

Referring now to FIG. 2, members 1 to 10 have the same meanings as explained with reference to FIG. 1, and the shape and the function of these members is the same as in FIG. 1; there are, however, two significant differences between the systems shown in FIGS. 1 and 2.

Firstly, aluminum strip 1 is not contacted with coloring bath 3 contained in coloring cell 2, but is contacted only with a coloring bath layer 12 formed on the surface of the travelling aluminum strip. When direct current is applied in this state between anode 8 and aluminum strip 1 while travelling the aluminum strip, an aluminum strip electrolytically colored on only one surface (the surface which is contacted with the coloring bath layer 12) is obtained. Secondly, in this embodiment the coloring time can be adjusted by changing the distance between coloring-adjustment rollers 11 and 11', i.e., the longer the distance between the rollers, the longer the coloring time at constant rates of travel. Rollers 11 and 11' function only to adjust the length of the coloring bath layer 12, and therefore can be in any shape, such as round or square, and can be made from a wide variety of materials, such as rubber, sponge, plastic and the like. Rollers 11 and 11' may be eliminated if the rollers 4 are shifted to a position closer to each other so as to function as rollers 11 and 11'.

The characteristic feature of the embodiment of FIG. 2 is that electrolytic coloring occurs only at the area near the hollow body 7 and the coloring bath layer 12. Thus, a hollow body can be provided facing the lower surface of the aluminum strip to thereby electrolytically color the lower surface of the aluminum strip, or the hollow body can be provided facing both the upper and lower surfaces of the aluminum strip, thereby electrolytically coloring both surfaces of the aluminum strip. Further, it is possible to electrolytically color the aluminum strip in special patterns, for example, in a stripe-pattern, by providing a particular type of hollow body. For example, a stripe-pattern coloring in which deeply-colored portions and lightly-colored portions are parallel to the travelling direction of the aluminum strip can be attained when the opening of one or more hollow bodies is partially covered with an appropriate member, such as a rubber plate or sponge, and electrolytic coloring is conducted while setting the partially covered hollow body or bodies close to the surface of the travelling aluminum strip.

In FIG. 2, the hollow body 7 is provided at the upper surface of the aluminum strip, but as previously described, two or more hollow bodies can be provided at the upper and/or lower surface of the aluminum strip.

In the embodiment illustrated in FIG. 2, the coloring bath sometimes tends to flow down to the edge portions of the lower surface of the aluminum strip, thereby partially coloring the edge portions. Such undesirable coloring can be prevented by increasing the flow rate of the coloring bath or by blowing pressurized air toward the lower surface of the aluminum strip.

The aluminum thus colored is then washed with water and can then be subjected to a conventional sealing treatment or various lacquer coating methods including electrodeposition, dipping and spraying, as are known in the art.

As will be apparent to one skilled in the art, when the electric polarity is reversed and an aqueous solution of sulfuric acid is used in place of the coloring bath in the embodiment shown in FIG. 2, only one surface of the aluminum strip can be anodically oxidized; such an embodiment is not contemplated in the present invention.

As previously described, in accordance with the process of this invention, a stable, uniformly colored aluminum strip or wire can be obtained without partial spalling of the colored film. Also, since the process of this invention makes it possible to electrolytically color only one surface of an aluminum strip and, if desired, to color an aluminum strip in a stripe-pattern, various colored aluminum strips suitable for use in wide variety of utilities can be obtained.

In addition, as a most significant feature of the process of this invention, anodically oxidized aluminum having a very thin anodic oxide film thereon, for example, an anodic oxide film having a thickness of 1 to 2 $\mu$, which could not be effectively electrolytically colored by conventional electrolytic coloring processes, can be colored stably and uniformly by the process of this invention. The above fact indicates that electrolytically colored strips and wires having an excellent resistance to weathering can be produced at low cost and, therefore, the effects brought about by the present invention are very important economically.

The present invention will be illustrated in further detail by reference to the following Examples, but is not restricted thereto as the examples were conducted on a small scale for purposes of illustration.

EXAMPLE 1

A coiled aluminum strip 65 mm (width) $\times$ 0.3 mm (thickness) having an aluminum content of 99.2% was mounted on the uncoiling means of an apparatus comprising an uncoiler, etching cell, washing cell, current supplying cell, anodic oxidation cell, washing cell, electrolytic coloring cell, washing cell, sealing cell and a recoiler, and passed through the recited units in the order given. The apparatus used was substantially identical to that disclosed in U.S. Application Ser. No. 450,259, filed Mar. 11, 1974, now U.S. Pat. No. 4,002,549 except, of course, for the novel coloring means of the present invention.

In the electrolytic coloring cell, the aluminum strip was immersed in a coloring bath and two hollow bodies were positioned facing both surfaces of the aluminum strip, as shown in FIG. 1. Each of the hollow bodies was in the form of a circular cylinder having a diameter of 30 mm and a length of 100 mm. The hollow body was provided with a slit extending axially throughout the length thereof, the width of the slit being 1 mm. An anode plate of nickel was housed along the axis thereof, the dimensions of the anode plate being 20 mm × 80 mm × 0.5 mm. The hollow bodies were disposed perpendicularly to the travelling direction of the strip, the distance between the strip and each hollow body being 1 mm. The aluminum strip was treated as described hereinafter.

The aluminum strip was introduced into the etching cell through the uncoiler at a rate of 20 cm/min, and contacted therein with a 10% aqueous sodium hydroxide solution at a bath temperature of 50° C for 1 minute, and passed therethrough to the washing cell where the aluminum strip was passed through a water bath.

The resulting strip was then introduced into the current supplying cell which contained a 30% aqueous sulfuric acid solution in which was disposed a carbon anode plate, wherein the aluminum strip was subjected to electrolysis at a current density of 2.0 A/dm$^2$ at a bath temperature of 25° C for 4.5 minutes (electrolysis time), the aluminum strip acting as a cathode.

The aluminum strip was then introduced into the anodic oxidation cell which contained a 30% aqueous sulfuric acid solution in which was disposed a carbon cathode plate, wherein the aluminum strip was subjected to anodic oxidation at a current density of 2.0 A/dm$^2$ and a bath temperature of 25° C for 5 minutes (electrolysis time) to thereby form an oxide film of a thickness of about 3 microns on the aluminum strip.

After subsequently passing through a washing cell as above, the aluminum strip was introduced into the electrolytic coloring cell in which the hollow bodies were disposed, as earlier described, and subjected to cathodic electrolysis. The electrolytic bath in the electrolytic coloring cell comprised an aqueous solution of 50 g/liter of nickel sulfate and 30 g/liter of boric acid. While injecting this electrolytic bath at a rate of 8 liter/min per 1 cm$^2$ of the opening area of the hollow body, the aluminum strip was subjected to cathodic electrolysis at a current density of 1.0 A/dm$^2$ and a bath temperature of 25° C for a coloring time of 20 seconds (electrolysis time). As a result, both surfaces of the aluminum strip were uniformly colored bronze without undesirable defects such as stripe-pattern or film-breakage.

The aluminum strip thus colored was then passed through a washing cell as above described, then introduced into the sealing cell in which the aluminum strip was sealed with pure water at 93° C for 8 minutes (the color tone of the aluminum strip thus treated did not change) and coiled.

The colored aluminum strip thus obtained had excellent processability, and cracks in the oxide film on the aluminum strip were hardly encountered even when the aluminum strip was subjected to press processing or roll processing.

EXAMPLE 2

An aluminum strip was colored on one surface using the same apparatus as employed in Example 1 except that a hollow body was provided at only one surface of the aluminum strip as shown in FIG. 2.

The aluminum strip was treated under the same conditions as employed in Example 1 to the anodic oxidation cell. After passing through the anodic oxidation cell, the aluminum strip was further passed through the washing cell and then introduced into the electolytic coloring cell containing therein the same electrolytic bath as was employed in Example 1. In this step, while injecting the electrolytic bath at a rate of 10 liter/min. per 1 cm$^2$ of the opening area of the hollow body, the aluminum strip was subjected to cathodic electrolysis at a current density of 1.0 A/dm$^2$ and at a bath temperature of 25° C for a coloring period of 10 seconds (electrolysis time). After completion of this treatment, the aluminum strip was successively passed through the washing cell and the sealing cell under the same conditions as employed in Example 1 and then coiled.

As a result only the surface of the aluminum strip facing the hollow body was uniformly colored bronze. The aluminum strip thus obtained was found to have excellent processability the same as that obtained in Example 1.

While the invention has been described in detail and with reference to specific embodiments thereof, it will be apparent to one skilled in the art that various changes and modifications can be made therein without departing from the spirit and scope thereof.

What is claimed is:

1. In a process for electrolytically coloring an anodically oxidized aluminum or aluminum base alloy strip or wire as a cathode in a coloring bath comprising an aqueous solution containing at least one nickel salt, cobalt salt, tin salt, iron salt, copper salt or selenious acid while continuously travelling said anodically oxidized aluminum or aluminum base allow strip or wire, the improvement which comprises subjecting said anodically oxidized aluminum or aluminum base alloy strip or wire as a cathode to direct current electrolysis using an electrolytic coloring means comprising at least one hollow body which has an anode therein, said anode being insulated from said hollow body, and has an opening of slit shape for continuously and uniformly supplying the coloring bath onto at least one surface of said strip or wire, the longitudinal direction of the slit being perpendicular to the direction of travel of said strip or wire in order that the coloring rate of said strip or wire becomes a maximum value at the portions in the vicinity of said hollow body, while continuously supplying said coloring bath onto at least one surface of said aluminum or aluminum base alloy strip or wire.

2. The process according to claim 1, wherein said hollow body is provided at one surface of the anodically oxidized aluminum or aluminum base alloy strip or wire.

3. The process according to claim 1, wherein said coloring bath is in the form of a layer on the surface of the anodically oxidized aluminum or aluminum base alloy strip or wire.

4. The process according to claim 1, wherein said direct current electrolysis in said coloring bath is conducted for a period of about 30 seconds or less.

5. The process according to claim 1, wherein the distance between the lower portion of said opening provided in said hollow body and the surface of said strip or wire facing said opening is controlled to be less than about 100 mm.

* * * * *